US006011570A

United States Patent [19]

Muranaka et al.

[11] Patent Number: 6,011,570

[45] Date of Patent: Jan. 4, 2000

[54] REWRITABLE MEDIUM RECORDING APPARATUS

[75] Inventors: Takanori Muranaka, Tamana; Hitoshi Shimaoka; Masanobu Katsumura, both of Kumamoto, all of Japan

[73] Assignee: Matsushita Electric Industrial Co., Ltd., Osaka, Japan

[21] Appl. No.: 08/987,090

[22] Filed: Dec. 9, 1997

[30] Foreign Application Priority Data

Dec. 17, 1996 [JP] Japan ..... 8-336573
Dec. 26, 1996 [JP] Japan ..... 8-347244

[51] Int. Cl.[7] ..... B41J 2/32

[52] U.S. Cl. ..... 347/171

[58] Field of Search ..... 347/197, 171, 347/194; 400/120.01; 503/227

[56] References Cited

U.S. PATENT DOCUMENTS 4,695,528 9/1987 Dabisch et al. .
5,189,658 2/1993 Moses .
5,896,159 4/1999 Masubuchi et al. ..... 347/194

*Primary Examiner*—Huan Tran
*Attorney, Agent, or Firm*—Stevens, Davis, Miller & Mosher, L.L.P.

[57] ABSTRACT

When a visible image on a printing area of a rewritable recording medium is erased by an erase head, a control unit and an erasing control device, respectively, control the electric current supplied to the erase head, based on a power supply pattern recorded in a storage device and a temperature information from a first temperature detecting device for measuring the ambient temperature.

9 Claims, 14 Drawing Sheets

REWRITABLE MEDIUM RECORDING APPARATUS

BACKGROUND OF THE INVENTION

This invention relates to a rewritable medium recording apparatus which can handle a card having a thermally reversible color developing layer.

Recently, there have been widely spread rewritable medium recording apparatuses of the type having, in addition to the function of recording and reproducing magnetic information by means of a magnetic head, a rewrite function by which the information printed can be rewritten over and over by means of a thermal head and an erase head, in order to handle a card having a thermally reversible color developing layer on which the information is visible as characters. The card system comprising the combination of such card and rewritable medium recording apparatus can be applied to a broad field including the point card system for shopping center, card system for staff's cafeteria and card system for the rental business, by making use of the characteristic that the information is visible.

A summary of thermally reversible color developing layer of such card will be described with reference to FIG. 9 which is a plan view of a card having a thermally reversible color developing layer and FIG. 10 which is a characteristic diagram showing the color developing/erasing characteristics of the thermally reversible color developing layer.

In FIG. 9, a card 1 has a thermally reversible color developing layer formed on the entire silver base, and is printed except in a printable printing area 1*a*. Since the printing area 1*a* is normally transparent, it appears silver which is the color of the base, but when it is heated at a predetermined temperature, heated portions turn white so that white characters appear on the silver background. The card 1 is formed on the back thereof, opposite to the printing area 1*a*, with a recording layer on which information can be recorded by making use of the magnetism.

The thermally reversible color developing layer is summarized as follows. As shown in FIG. 10, distributed in the thermally reversible color developing layer is a low-molecular substance having the property that the crystal structure thereof is changed when receiving the thermal energy. In the condition shown at a point A, since the crystal structure of the low-molecular substance is in the large single crystal state, the light is allowed to transmit so that the thermally reversible color developing layer appears to be transparent. On the other hand, in the condition shown at a point B, the crystal structure is in the polycrystal state, and therefore the light is scattered to cause the thermally reversible color developing layer to become opaque, with the result that the thermally reversible color developing layer appears white.

Explaining this phenomenon in connection with the color developing/erasing characteristics, if a card in the transparent condition shown at the point A is heated, it starts to become opaque at temperatures 90 to 100° C. and, If cooled down to room temperature from this condition, it is turned into the completely opaque condition as shown at the point B. On the other hand, if the card in the opaque condition shown at the point B is heated, it is turned into the transparent condition at temperatures around 80° C., and therefore it is possible to reversibly perform the color developing/erasing process by repeated change in condition between transparent and opaque.

Now, the structure of a conventional rewritable medium recording apparatus will be described. FIG. 11 is a schematic view showing the structure of the conventional rewritable medium recording apparatus, and FIG. 12 is a plan view of a card used for the conventional rewritable medium recording apparatus.

In FIGS. 11 to 12, a rewritable medium recording apparatus 2 comprises a recording head 3 by which at least one of recording and reproduction of information on a recording layer of a card 1 is performed by making use of magnetism, a printing unit 5 having a print head 4 by which information is printed on a thermally reversible color developing layer of the card 1, and an erasing unit 7 having an erase head 6 by which the information printed on the thermally reversible color developing layer is erased. The card 1 used for the rewritable medium recording apparatus 2 has a thermally reversible color developing layer on one surface and a recording layer on the other on which information can be recorded, reproduced and erased by means of the recording head 3. By heating a printing area 1*a* on the thermally reversible color developing layer by means of the print head 4, characters are printed white to become visible.

The card 1 is inserted in a slot 8 of the printing unit 5 with its printing area 1*a* facing up and caused to reciprocate twice by means of feed rollers 9 to 11 driven by drive means (not shown), during which all process is completed.

In the first reciprocation, at least one of recording and reproduction of information on the recording layer on the back of the card 1 is performed by means of the recording head 3, while the card 1 is conveyed forward by the feed rollers 9 to 10. Then, the card 1 is fed into the erasing unit 7 by the feed rollers 11 for the purpose of erasing the information printed. When the card 1 is brought to a stop in the erasing unit 7, a table 13 adapted to be moved up and down by a solenoid 12 is moved upward until the printing area 1*a* of the card 1 is pressed against the erase head 6 heated to a temperature around 80° C., thereby erasing the information printed. In this case, the whole printing area 1*a* of the card 1 is subjected to erasing because the width of the printing area 1*a* in the longitudinal direction of the card 1 coincides with the width of the erase head 6. After the above process is completed, the feed rollers 11 are rotated reversely so that the card 1 is fed back into the printing unit 5 again to make ready for the printing process.

In the second reciprocation, character information is written in turn on the printing area 1*a* on the front of the card 1 by means of the print head 4 in the printing unit 5. The print head 4 is enabled to move up and down when being driven by a solenoid 14. When the card 1 is on the platen roller 15, the print head 4 is lowered to be pressed against the printing area 1*a* and then a large number of heating resistance elements of the print head 4 are heated to a temperature around 100° C. according to the print pattern, thereby printing optional characters, figures and the like on the printing area 1*a* of the card 1. After the above process is completed, the card 1 is conveyed by the feed rollers 9 to 10 so as to be caused to pass over the recording head 3. While the feed rollers 9 to 10 are rotated reversely to cause the card 1 to pass over the recording head 3, the information recorded is verified. Thereafter, the card 1 is released out of the slot 8.

However, in the conventional rewritable medium recording apparatus described above, when erasing the information printed on the card 1 in the erasing unit 7, the printing area 1*a* of the card 1 shown in FIG. 12 is subjected to erasing over a wide range all at once by means of the stamp type erase head 6. This inevitably causes the erasing unit 7 to be increased in size, and therefore it has been necessary to provide the erasing unit 7 separately from the printing unit 5. Further, since the card 1 fed into the erasing unit 7 must be fed back into the printing unit 5 after the erasing process, the card 1 should undergo the erasing process while being held between the feed rollers 11. For this reason, since it is necessary For the card 1 to reserve a space for holding, a considerably wide area is occupied by unusable portion, giving rise to a problem that the printing area 1*a* that can be set on the card 1 (in FIG. 12, approx. 40 mm long in the longitudinal direction of the card 1) should inevitably be narrowed.

SUMMARY OF THE INVENTION

It is an object of the present invention to provide a rewritable medium recording apparatus which is capable of handling a card having a wide printing area while overcoming the above problem.

It is another object of the invention to provide a compact rewritable medium recording apparatus.

It is still another object of the invention to provide a low-power rewritable medium recording apparatus.

A further object of the invention is to provide a rewritable medium recording apparatus which is capable of recording and erasing visible images with certainty.

DETAILED DESCRIPTION OF THE INVENTION

Figure 1:
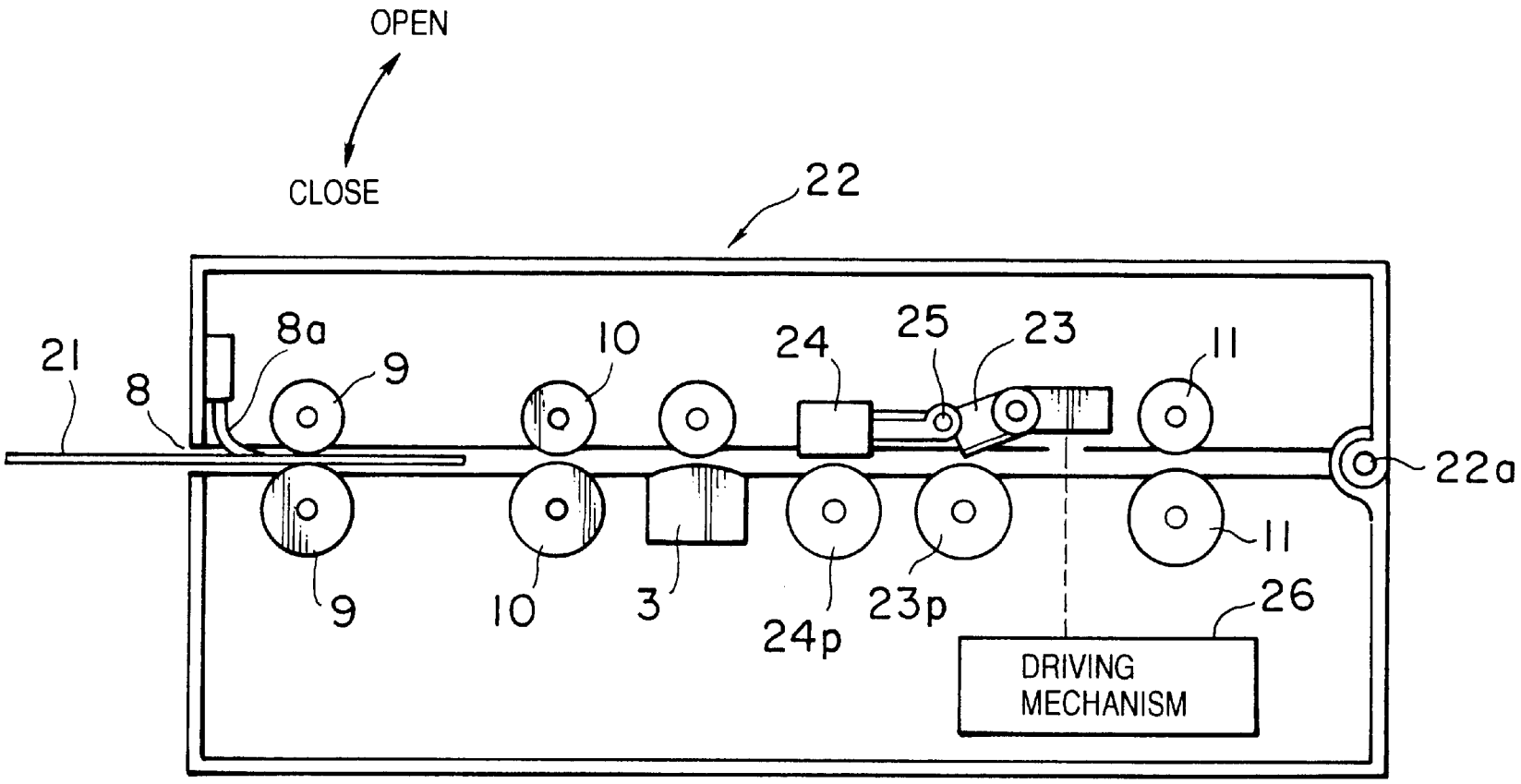
FIG. 1 is a schematic structural view of a rewritable medium recording apparatus according to a first embodiment of the present invention.

Now, a first embodiment of the present invention will be described with reference to FIGS. 1 to 8 in which the same components as the conventional apparatus are designated by the same reference numerals.

(Embodiment 1)

Figure 2:
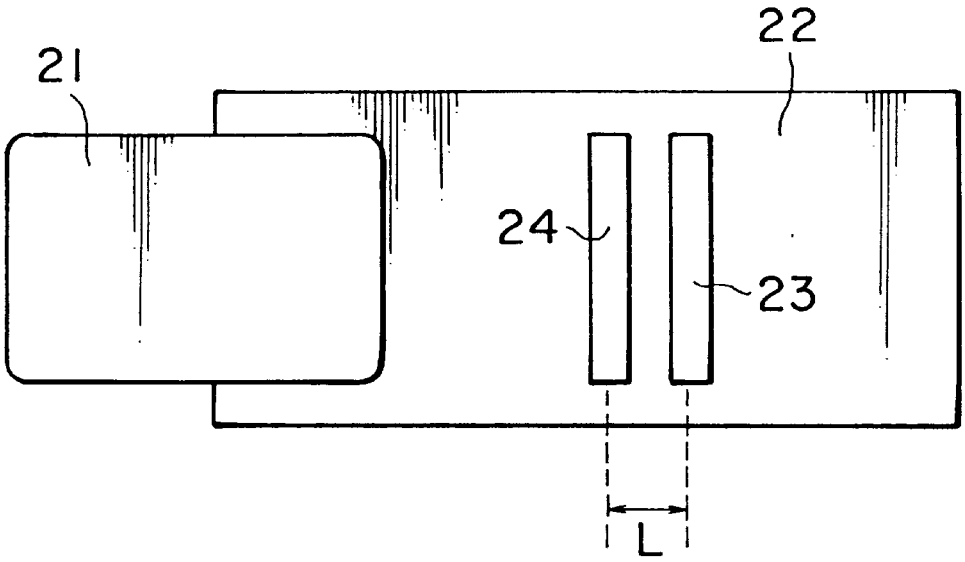
FIG. 2 is a schematic plan view showing essential portions of the rewritable medium recording apparatus according to the first embodiment of the invention.
Figure 3:
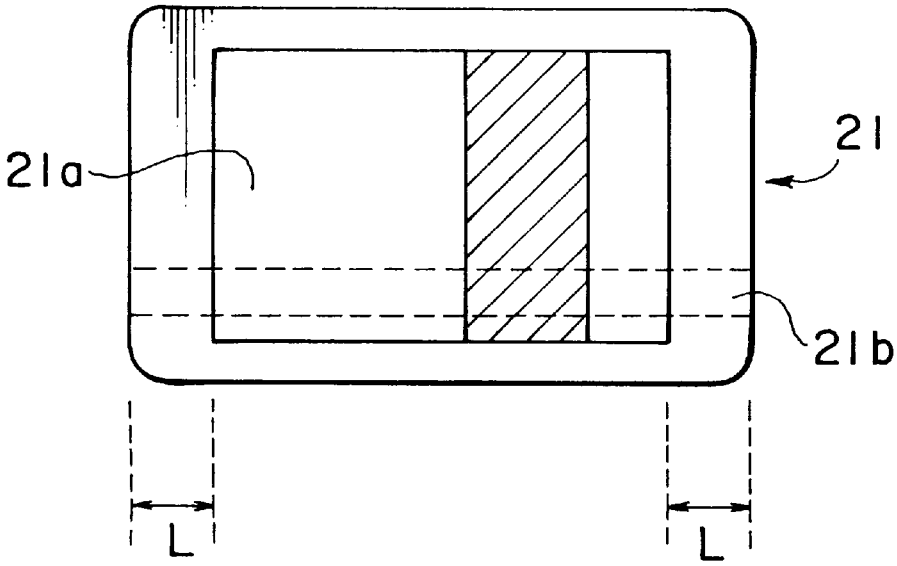
FIG. 3 is a plan view of a card used for the rewritable medium recording apparatus according to the first embodiment of the invention.
Figure 4:
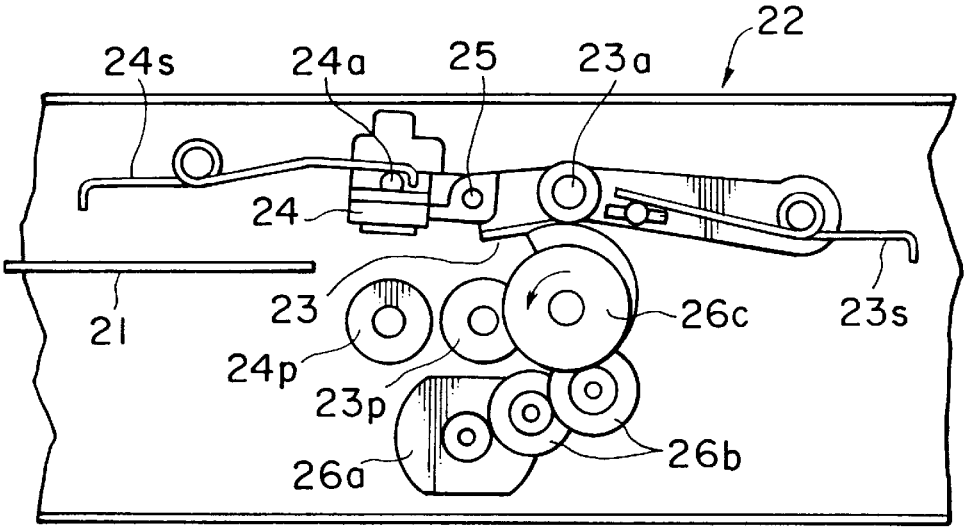
FIG. 4 is a schematic view showing the behavior of erase and print heads of the rewritable medium recording apparatus according to the first embodiment of the invention.
Figure 5:
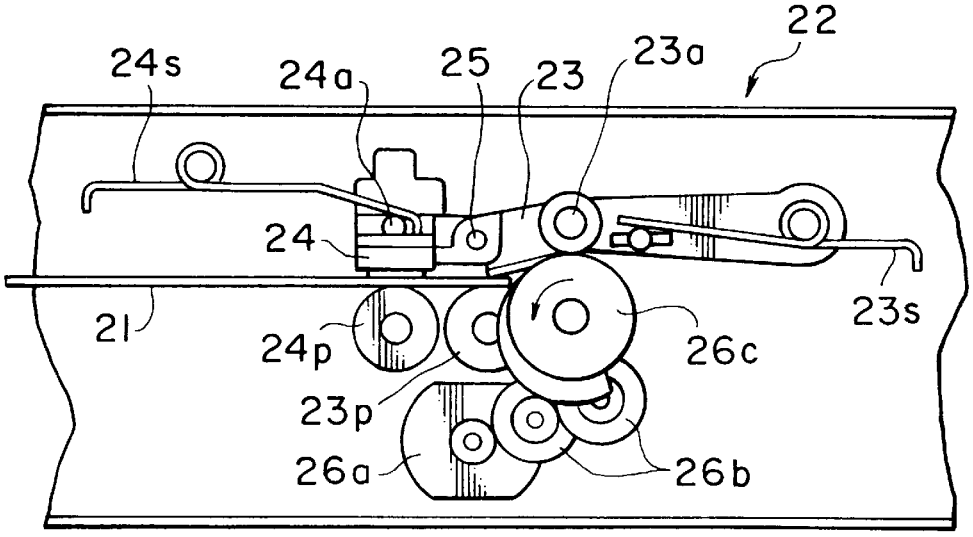
FIG. 5 is a schematic view showing the behavior of the erase and print heads of the rewritable medium recording apparatus according to the first embodiment of the invention.

FIG. 1 is a schematic view showing the structure of a rewritable medium recording apparatus according to a first embodiment of the present invention, FIG. 2 is a schematic plan view showing essential portions of the rewritable medium recording apparatus according to the first embodiment of the invention, and FIG. 3 is a plan view of a card used for the rewritable medium recording apparatus according to the first embodiment of the invention. FIGS. 4 and 5 are schematic views showing the behavior of erase and print heads of the rewritable medium recording apparatus according to the first embodiment of the invention.

In FIGS. 1 to 3, a rewritable medium recording apparatus 22 comprises a recording head 3 by which at least one of recording and reproduction of information on a recording layer of a rewritable recording medium 21 is performed by making use of magnetism, a print head 23 by which information is printed on a thermally reversible color developing layer of the rewritable recording medium 21, and an erase head 24 by which the information printed in the thermally reversible color developing layer is erased. The print head 23 and the erase head 24 are connected by means of a pin 25 so that a driving mechanism 26, which is to be described later, causes the two heads to come into and out of contact with the rewritable recording medium 21 in cooperation with each other. The rewritable recording medium 21 used for the rewritable medium recording apparatus 22 has a thermally reversible color developing layer on one surface thereof and a recording layer on the other thereof on which information can be recorded and reproduced by means of the recording head 3. By heating a printing area 21*a* on the thermally reversible color developing layer by means of the print head 23, characters are printed white to become visible.

The rewritable recording medium 21 is inserted into a slot 8 of the rewritable medium recording apparatus 22 with its printing area 21*a* facing up. Provided in the vicinity of the slot 8 is a discharge brush 8*a* as an example of discharge means in order to remove the static electricity charged on the rewritable recording medium 21. The discharge brush 8*a* needs not be always provided in the vicinity of the slot 8 but may be provided at any appropriate location on the conveying path for the rewritable recording medium 21. Since the static electricity of the rewritable recording medium 21 can be removed by the discharge function of the discharge brush 8*a*, adverse effect of the static electricity on the recording layer formed on the back of the rewritable recording medium 21 can be prevented as much as possible. The rewritable recording medium 21 inserted into the slot 8 is caused to reciprocate twice by means of feed rollers 9 to 11 driven by drive means (not shown), during which all process is completed.

In the first recipocation, while the rewritable recording medium 21 is conveyed forward at high speed (approx. 400 mm/sec) by the feed rollers 9 to 11, at least one of recording and reproduction of information on the recording layer on the back of the recording medium is performed by the recording head 3, and then the rewritable recording medium 21 is conveyed backward at high speed again until it returns to its initial state in which it is held between the feed rollers 9 to 10.

In the second reciprocation, in order to erase and print information on the thermally reversible color developing layer of the printing area 21*a*, the rewritable recording medium 21 is conveyed forward at high speed to a predetermined position located on platen rollers 24*p*, 23*p*. As soon as the rewritable recording medium 21 arrives at the predetermined position where the information is to be erased and printed, conveyance of the rewritable recording medium 21 is changed from high-speed conveyance to low-speed conveyance (approx. 30 mm/sec). As shown in FIGS. 4 to 5, a lift cam 26*c* is rotated through reduction gears 26*b* by means of a motor 26*a* of the driving mechanism 26. Then, a spring 24*s* for pressing down the erase head 24 and a spring 23*s* for pressing down the print head 23 cooperate to lower the erase head 24 and the print head 23. In this condition, as shown in FIG. 3, the erase head 24 is first heated to a temperature around 80° C. to erase only the selected portions in the printing area 21*a* of the rewritable recording medium 21 conveyed, and then the print head 23 is heated to a temperature around 100° C. to print optional characters, figures and the like only on the selected portions in the printing area 21*a*. After the above process is completed, the feed rollers 9 to 11 are rotated reversely so that the rewritable recording medium 21 is conveyed backward at high speed until it is released out of the slot 8. While the rewritable recording medium 21 passes over the recording head 3, the information recorded is verified.

As described above, the rewritable medium recording apparatus 22 has such a structure that both of the erase head 24 and the print head 23 are moved up and down by the driving mechanism 26 alone, and therefore it becomes possible to simplify the driving mechanism 26 by which the erase and print heads are caused to come into and out of contact with the rewritable recording medium 21. Further, since the erase head 24 and the print head 23 are rotatably mounted on a shaft 24*a* and a shaft 23*a*, respectively, the two heads are allowed to tilt independently of each other, thereby making it possible to obtain the optimum contact between the two heads and the rewritable recording medium 21. If it is possible to obtain the optimum contact, that is, if the two heads can perfectly come into close contact with the rewritable recording medium 21, the printing area 21*a* of the rewritable recording medium 21 can be sufficiently heated by the two heads. This eliminates the occurrence of defects such as incomplete erasing and unclear print.

As shown in FIGS. 4 to 5, the rewritable medium recording apparatus 22 has the structure that the erase head 24 and the print head 23 are moved up and down simultaneously, and therefore printing cannot be effected before and behind the rewritable recording medium 21 over a certain range as shown in FIG. 3, which corresponds to a distance L between the center of the erase head 24 and the center of the print head 23 shown in FIG. 2. For this reason, since the erase head 24 and the print head 23 are arranged as close as possible in order to widen the printing area 21*a*, the printing area 21*a* can be secured about 60 mm in the longitudinal direction of the rewritable recording medium 21, which is one and a half times the size of the printing area of about 40 mm in the conventional card.

By the way, in the above-mentioned second reciprocation, when printing, the rewritable recording medium 21 receives a load given by the erase head 24 and the print head 23 at front and rear portions thereof corresponding to the two heads. When the diameter of the platen roller 24*p* for the erase head 24 is larger than the diameter of the platen roller 23*p* for the print head 23 due to variation in diameter of the platen rollers 24*p*, 23*p* or the like, there is produced a difference in conveying speed between the platen rollers 24*p* and 23*p*, whereby the rewritable recording medium 21 cannot be regularly conveyed. This causes the rewritable recording medium 21 to be pushed from behind. For this reason, the print head 23 is not allowed to sufficiently heat the printing area 21*a*, resulting in print skip in the form of a line.

In order to prevent such print skip, it suffices to subordinate the conveying speed of the platen roller 24*p* for the erase head 24 to the conveying speed of the platen roller 23*p* for the print head 23 at all times. For this purpose, the force of the spring 23*s* for pressing down the print head 23 is increased so that the load given to the rewritable recording medium 21 by the print head 23 exceeds the load given by the erase head 24. By doing so, even if the conveying speed of the platen roller 24*p* becomes higher than that of the platen roller 23*p*, the platen roller 24*p* is caused to idle, thereby making it possible to regulate the conveying speed.

Allowing for maintenance, an upper unit of the rewritable medium recording apparatus 22 is so attached as to be opened and closed about a shaft 22*a* in the direction shown by the arrow, as shown in FIG. 1. However, if the upper unit can be opened and closed too easily, when the rewritable medium recording apparatus 22 is opened by mistake while the rewritable recording medium 21 is being processed, the information stored on the recording layer of the rewritable recording medium 21 can be destroyed. To cope with this, the rewritable medium recording apparatus 22 is provided with a lock mechanism which can be released by something nearby.

Figure 7:
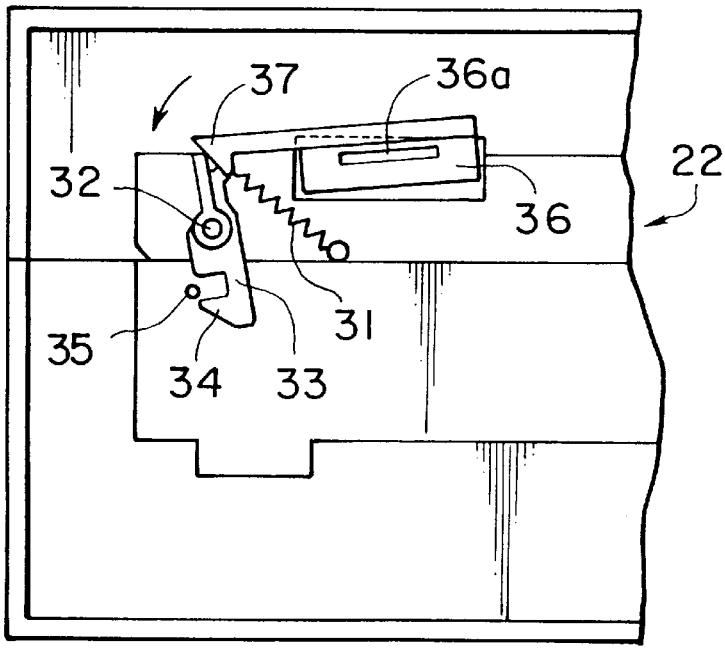
FIG. 7 is a schematic view showing the behavior of the lock mechanism of the rewritable medium recording apparatus according to the first embodiment of the invention.
Figure 8:
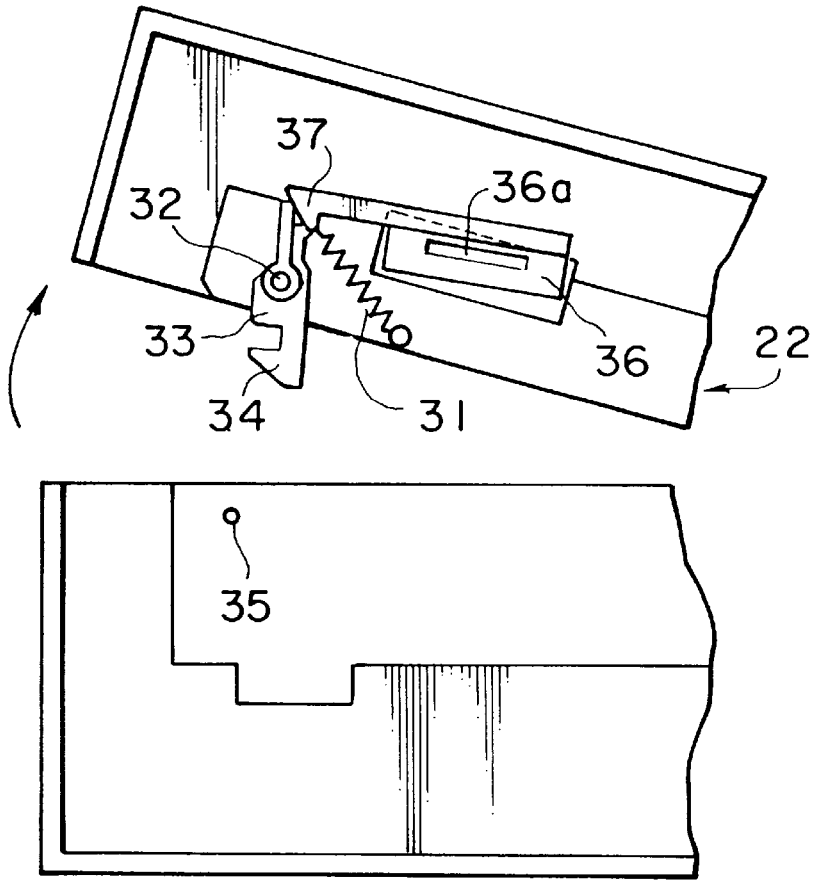
FIG. 8 is a schematic view showing the behavior of the lock mechanism of the rewritable medium recording apparatus according to the first embodiment of the invention.
Figure 9:
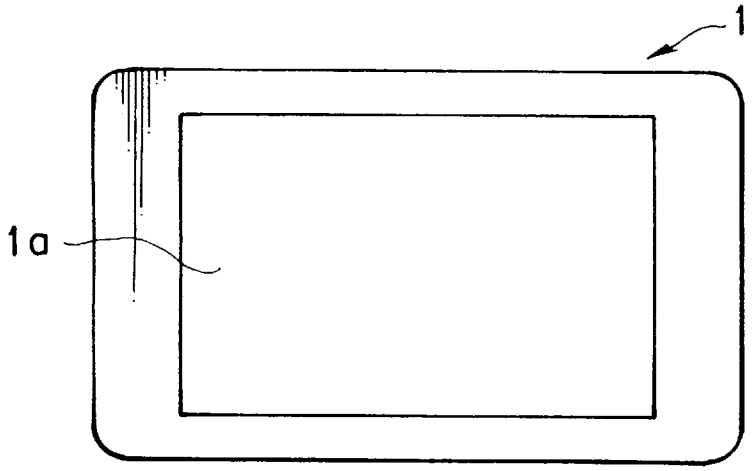
FIG. 9 is a plan view of a card having a thermally reversible color developing layer.
Figure 10:
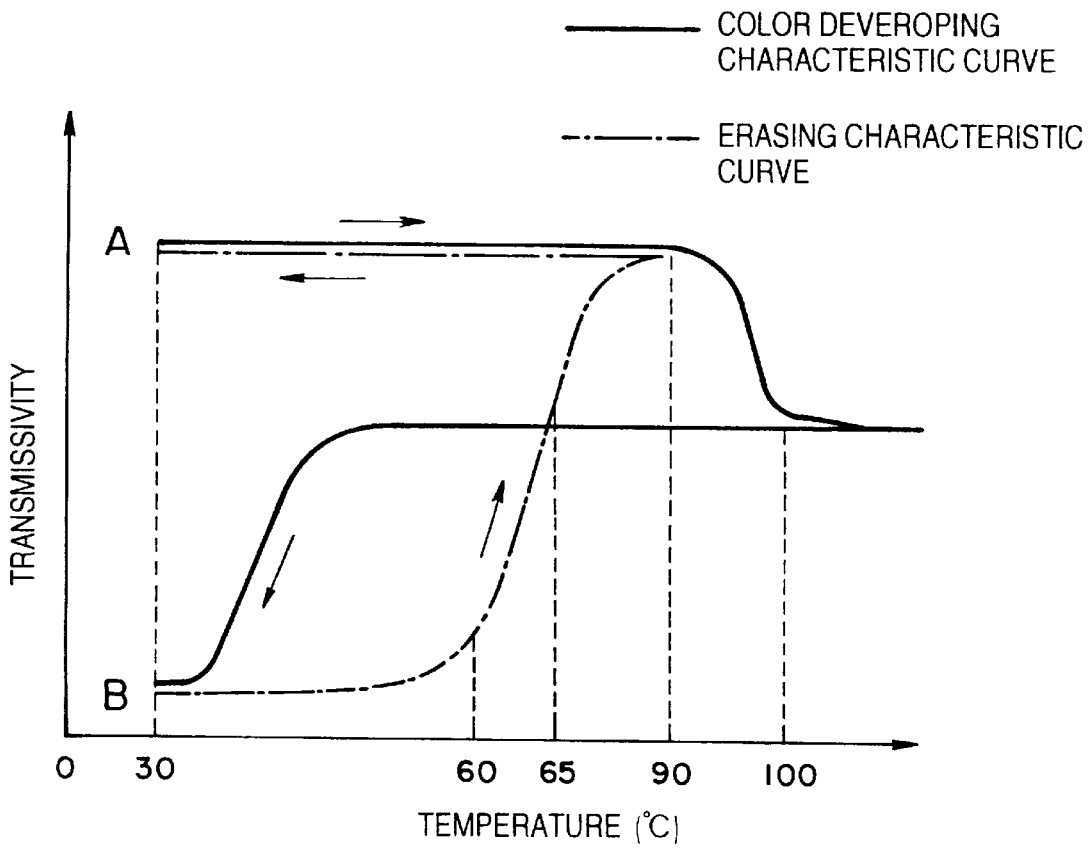
FIG. 10 is a characteristic diagram showing the color developing/erasing characteristics of the thermally reversible color developing layer.
Figure 11:
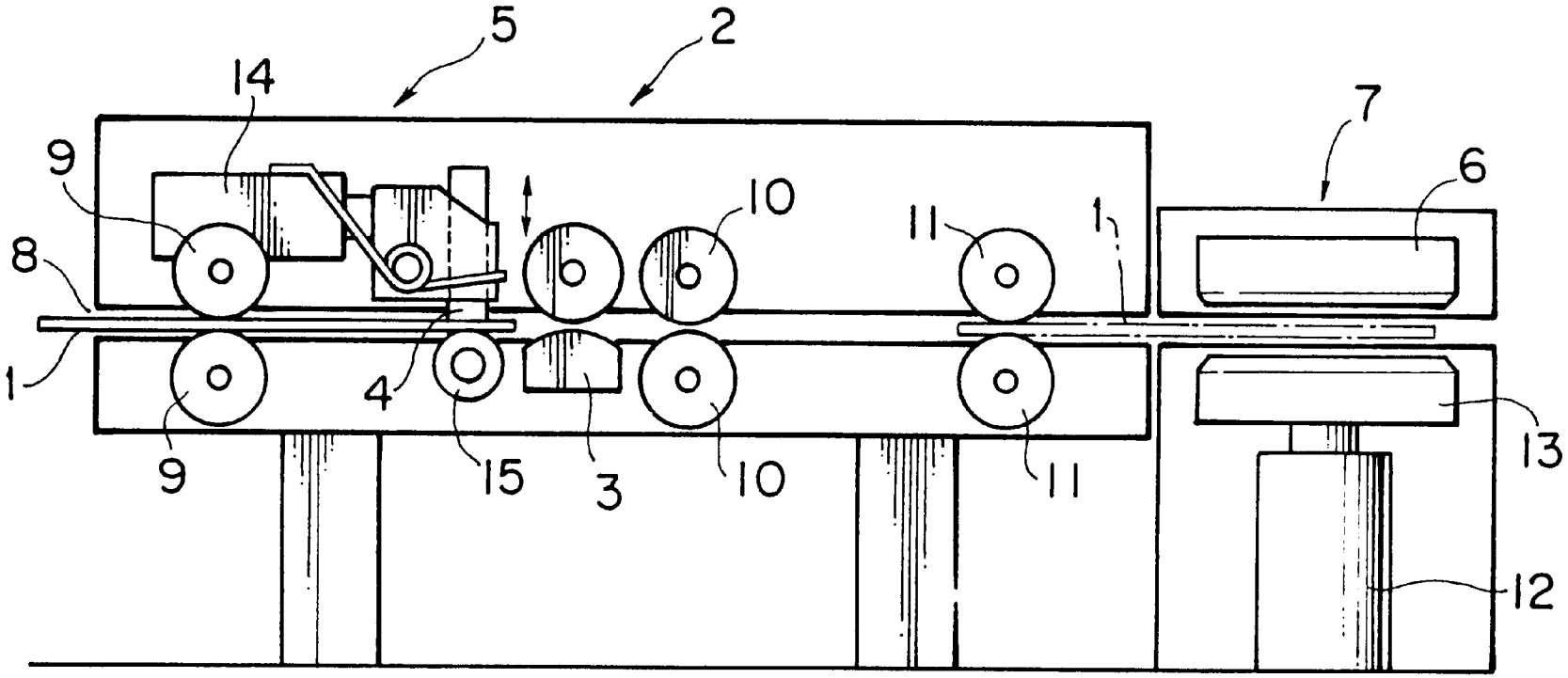
PRIOR ART FIG. 11
FIG. 11 is a schematic view of a conventional rewritable medium recording apparatus.
Figure 12:
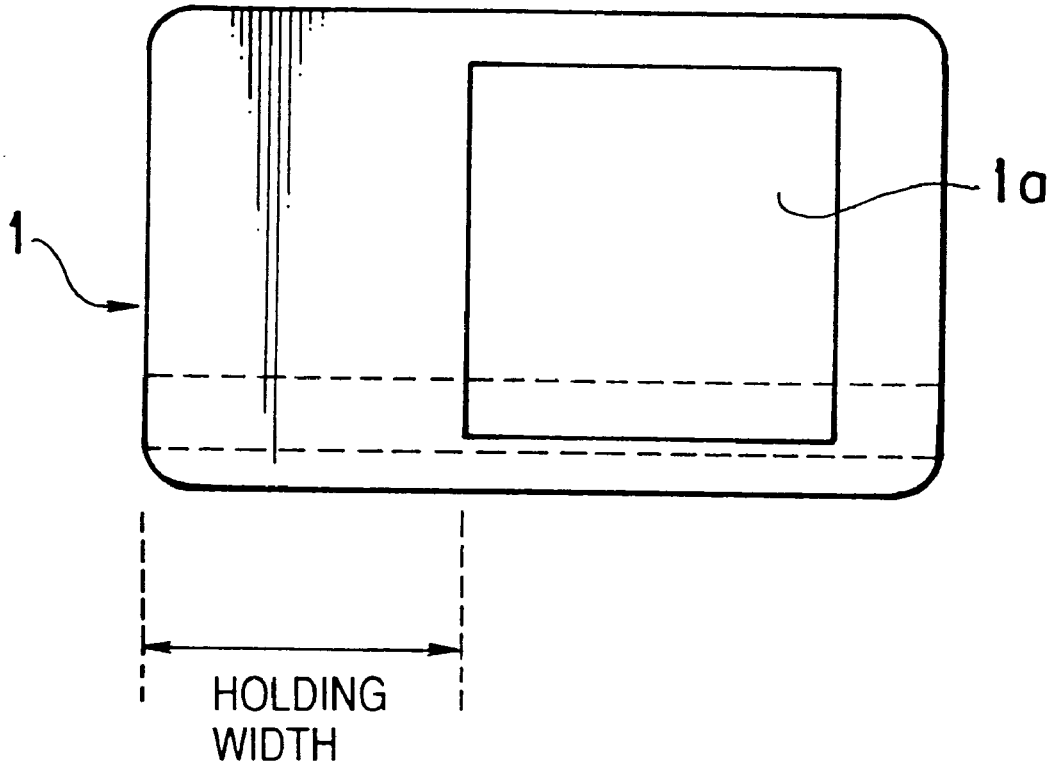
PRIOR ART FIG. 12
FIG. 12 is a plan view of a card used for the conventional rewritable medium recording apparatus.

Now, description will be given of the lock mechanism with reference to FIGS. 6 to 8 which are schematic views showing the behavior of the lock mechanism of the rewritable medium recording apparatus according to the first embodiment of the present invention.

Figure 6:
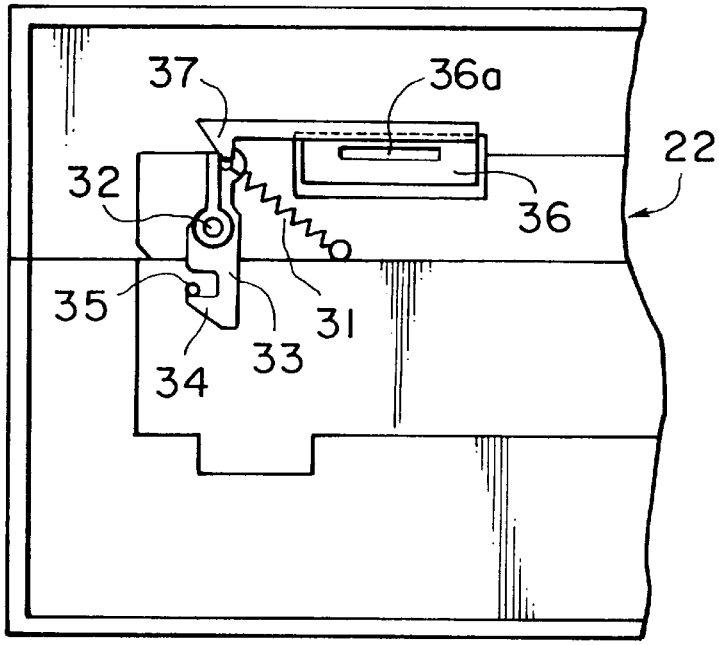
FIG. 6 is a schematic view showing the behavior of a lock mechanism of the rewritable medium recording apparatus according to the first embodiment of the invention.

As shown in FIG. 6, the lock mechanism of the rewritable medium recording apparatus 22 is incorporated in the upper unit of the rewritable medium recording apparatus 22 and functions in such a manner that a hook portion 34 of a hook member 33 engages with a fixed pin 35 of a lower unit of the rewritable medium recording apparatus 22, the hook member 33 being pulled by a spring 31 at one end with the central portion thereof supported by a fulcrum pin 32. The one end of the hook member 33 is caught by a stopper 37 extending from a lock button 36. As shown in FIG. 7, if is like a coin is inserted into a slot 36*a* of the lock button 36 and rotated counterclockwise, the hook member 33 is rotated to allow the hook portion 34 to be disengaged from the fixed pin 35. Then, as shown in FIG. 8, locked condition is released and the upper unit of the rewritable medium recording apparatus 22 may be opened. This lock mechanism has a feature in that it is secure since the locked condition cannot be released unless something is inserted to rotate the lock button 36, and that the locked condition can be easily released only by a person having an aim of releasing the locked condition because the lock button 36 can be rotated by inserting something nearby like a coin.

As described above, according to the present invention, in the rewritable medium recording apparatus comprising the recording head by which at least one of recording and reproduction of information on the recording layer of the card is performed, the print head by which information is printed on the thermally reversible color developing layer of the card, and the erase head by which the information printed on the thermally reversible color developing layer is erased, the erase head and the print head are so connected as to come into and out of contact with the card in cooperation with each other in an independently, inclined condition, and a single driving mechanism is used to cause the erase head and the print head to come into and out of contact with the card, and therefore it is possible to provide a rewritable medium recording apparatus which is capable of handling a card having a wide printing area and in which the casing is reduced in size.

(Embodiment 2)

Figure 13:
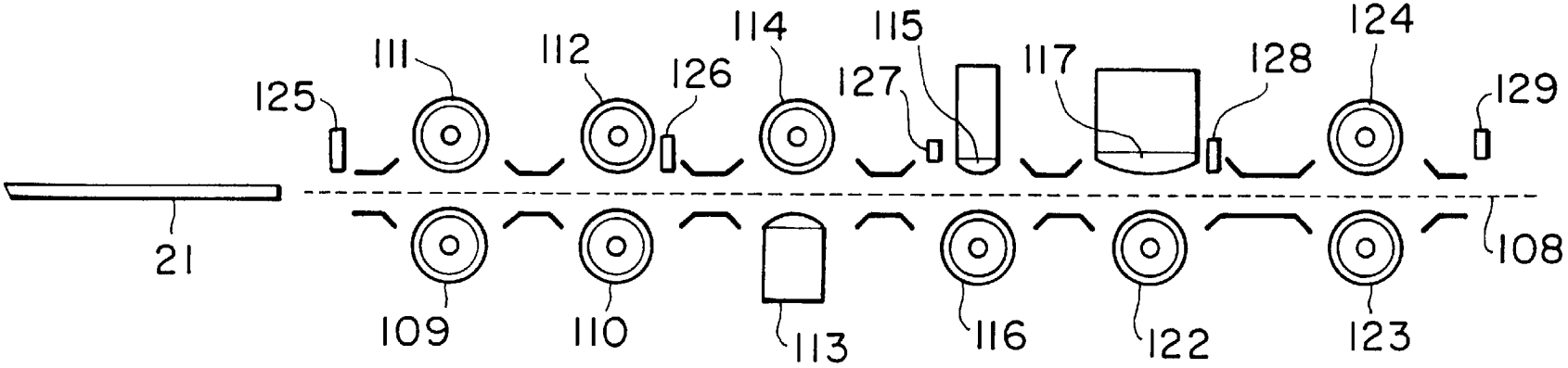
FIG. 13 is a sectional view of a rewritable medium recording apparatus according to a second embodiment of the present invention.

In FIG. 13, the reference numeral 21 denotes a rewritable recording medium; 108, a travelling path provided for the rewritable recording medium 21 to move in the rewritable medium recording apparatus; and 109, 110, driving rollers which are rotatively driven by a motor (not shown) or the like. Driven rollers 111, 112 are provided facing of the driving rollers 109, 110, respectively, with the travelling path 108 interposed therebetween. The rewritable recording medium 21 is taken into the rewritable medium recording apparatus by means of the driving rollers 109, 110 and the driven rollers 111, 112.

The reference numeral 113 denotes a magnetic head facing on the travelling path 108. The magnetic head 113 reads and writes data from and on a recording area 21*b* of the rewritable recording medium 21. In the case of this embodiment, if the magnetic head used as means for recording and reproducing data, data is magnetically recorded on the recording area 21*b* as a matter of course. In the present embodiment, description has been made as to the case where data is magnetically recorded on and reproduced from the rewritable recording medium 21, and however data may be optically read by means of an optical pickup or the like instead of the magnetic head 113 (it is a matter of course that data is optically recorded on the recording area 21*b*). In cases where data is optically recorded and reproduced by means of the optical pickup or the like, it is possible to deal with a large volume of data.

Furthermore, by mounting IC memory on the rewritable recording medium 21, data can also be electrically recorded and reproduced. In this case, it is necessary to transmit and receive signals with IC memory instead of the magnetic head 113. If data is electrically recorded and reproduced in this way, a large volume of data can be dealt with and data can be written on and read from the IC memory at high speed.

A pressure roller 114 is provided facing on the magnetic head 113 with the travelling path 108 interposed therebetween so that the rewritable recording medium 21 is held between the pressure roller 114 and the magnetic head 113 so as to bring the magnetic head 113 into close contact with the recording area 21*b*.

The reference numeral 115 denotes a thermal head for forming a visible image on the printing area 21*a* of the rewritable recording medium 21. The thermal head 115 is provided with a thermistor (not shown) for measuring the ambient temperature. The thermal head 115 may be one that has substantially the same structure as the usual thermal head used for the thermosensitive recording. In this case, the thermistor of the thermal head 115 is used for measuring the ambient temperature, controlling the applied voltage and the like of the thermal head 115, controlling the amount of heat generated by a large number of dot heating elements of the thermal head 115 and so on.

The reference numeral 116 denotes a platen roller provided facing on the thermal head 115 with the travelling path 108 interposed therebetween. The platen roller 116 is rotatively driven by a motor (not shown) or the like. The rewritable recording medium 21 is held between the platen roller 116 and the thermal head 115 so that the thermal head 115 is brought into close contact with at least the printing area 21*a* of the rewritable recording medium 21 to partially heat the printing area 21*a* to a predetermined temperature, thereby causing a good visible image to appear on the printing area 21*a*.

Figure 14A:
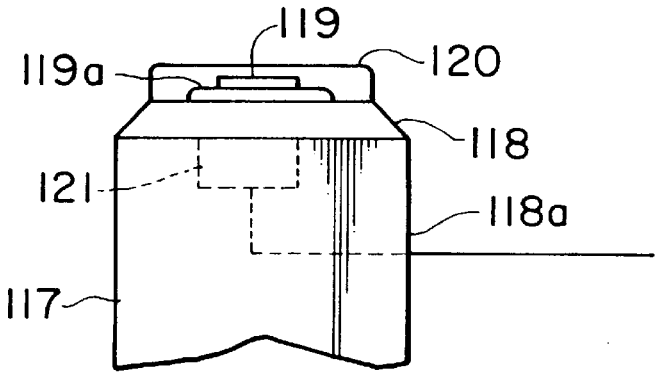
FIGS. 14A and 14B are illustrations showing an erase head used in the rewritable medium recording apparatus according to the second embodiment of the invention.
Figure 14B:
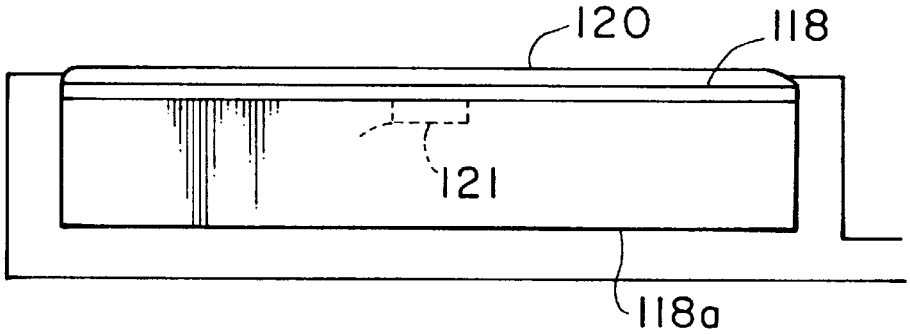
Figure 15:
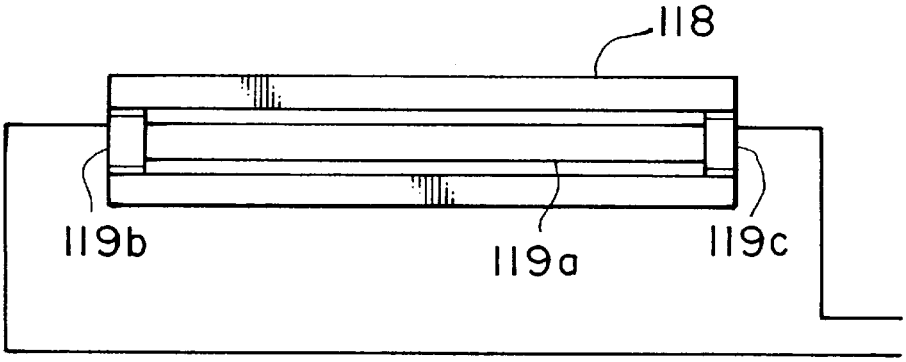
FIG. 15 is a plan view of the erase head used in the rewritable medium recording apparatus according to the second embodiment of the invention.
Figure 16:
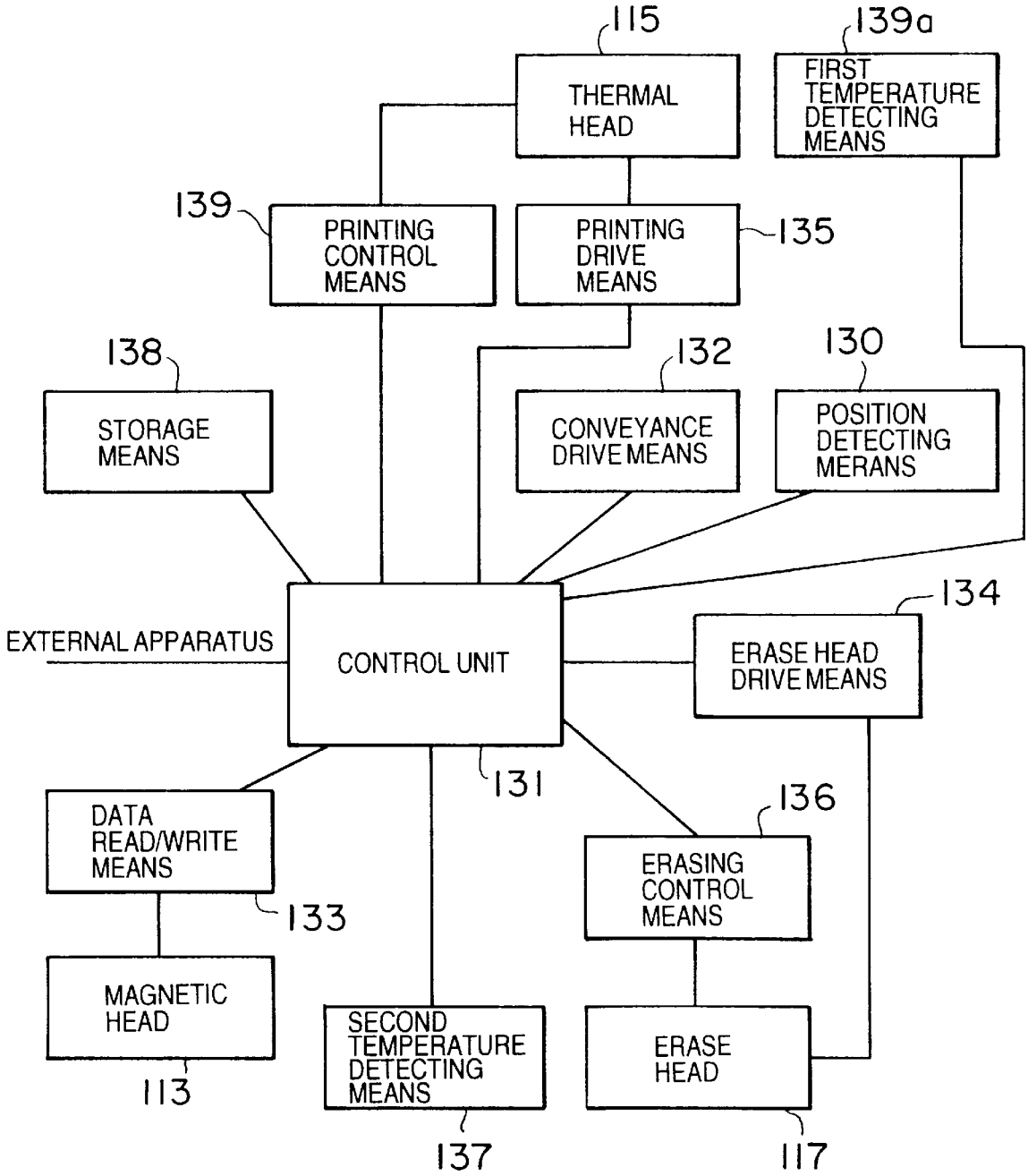
FIG. 16 is a block diagram of the rewritable medium recording apparatus according to the second embodiment of the invention.

The reference numeral 117 denotes an erase head for erasing the visible image displayed on the printing area 21*a* of the rewritable recording medium 21. The erase head 117 has a structure shown in FIGS. 14 and 15. In FIGS. 14A, 14B and 15, the reference numeral 118 denotes a base plate made of alumina or the like, the base plate 118 being fitted on a holder 118*a*. A heat storage layer 119*a* is provided on the base plate 118, and a thick-film heater 119 is formed on the heat storage layer 119*a*. Further, a protective layer 120 is formed on the thick-film heater 119 except at end portions of the thick-film heater 119. The thick-film heater 119 is made of a material of silver-palladium group, for example, and the protective layer 120 is generally made of amorphous glass. The thick-film heater 119 is applied with a predetermined electric current in the form of a rectangular wave by erasing drive means, which is to be described later, so as to be heated. A thermistor 121 for measuring the temperature of the thick-film heater 119 is provided on the side of the base plate 118 opposite to the side on which the thick-film heater 119 is provided. The thermistor 121 is put in a cavity or a hole formed in the holder 118*a* while being kept in direct contact with the base plate 118. It is essentially desirable that the thermistor 121 measures the temperature of the protective layer 120, but the protective layer 120 is brought into direct contact with the rewritable recording medium 21 to preclude actually arranging the thermistor 121 on the side of the thick-film heater 119. Accordingly, the thermistor 121 measures the temperature of the base plate 118 instead of the temperature of the protective layer 120, taking notice of the fact that the temperature of the base plate 118 and the temperature of the protective layer 120 are correlated. The reference numerals 119*b*, 119*c* denote electrode portions provided at opposite ends of the thick-film heater 119. Lead wires and the like are connected to each of the electrode portions 119*b*, 119*c*.

The reference numeral 122 denotes a platen roller provided facing on the erase head 117 with the travelling path 108 interposed therebetween. The platen roller 122 is rotatively driven by a motor (not shown) or the like. The rewritable recording medium 21 is held between the platen roller 122 and the erase head 117 so that the erase head 117 is brought into close contact with the printing area 21*a* of the rewritable recording medium 21 to heat the whole printing area 21*a* up to a predetermined temperature, thereby erasing the visible image on the printing area 21*a*.

The reference numeral 123 denotes a driving roller which is rotatively driven by a motor (not shown) or the like. The driving roller 123 cooperates with a driven roller 124, which is provided facing thereon with the travelling path 108 interposed therebetween, to allow the rewritable recording medium 21 to move along the travelling path 108.

Incidentally, the driving rollers 109, 110, 123 and the platen rollers 116, 122 are rotatively driven by a common motor (not shown) while being synchronized with each other through the medium of belts, gears and so on, which makes it possible to simplify the structure and realize the stable movement of the rewritable recording medium 21 along the travelling path 108.

The reference numerals 125, 126, 127, 128 and 129 denote sensors for measuring moving positions and the like of the rewritable recording medium 21, the sensors 125, 126, 127, 128 and 129 comprising photosensors or the like.

Operation and the like of the rewritable medium recording apparatus constructed as described above will be described with reference to FIGS. 13 to 16.

First of all, when position detecting means 130 comprising the sensors 125, 126, 127, 128 and 129 detects insertion of the rewritable recording medium 21 into the apparatus, a control unit 131 sends a signal to conveyance drive means 132 so as to drive the motor (not shown) or the like to rotate the driving rollers 109, 110, 123 and the platen rollers 116, 122. Then, the rewritable recording medium 21 begins to move along the travelling path 108 while being held between the driving rollers 109, 110 and the driven rollers 111, 112.

The recording area 21*b* of the rewritable recording medium 21 first slides on the magnetic head 113. The control unit 131 sends a control signal to data read/write means 133 to permit the magnetic head 113 to read out the data recorded on the recording area 21*b*. Reproduced signal read out at this time is transmitted to an external apparatus or the like, for example.

The rewritable recording medium 21 is conveyed as far as the sensor 129. At this time, the thermal head 115 and the erase head 117 are retreated from the travelling path 108.

When the sensor 129 detects that the rewritable recording medium 21 reaches as far as the sensor 129, the position detecting means 130 outputs a signal to the control unit 131. On receiving the signal, the control unit 131 sends a control signal to the conveyance drive means 132 so as to stop the operation of the motor (not shown) or the like. In consequence, the driving rollers 109, 110, 123 and the platen rollers 116, 122 are stopped in rotatively driven movement to cause the rewritable recording medium 21 to stand by at the end of the travelling path 108.

The control unit 131 sends control signals to erase head drive means 134 and printing drive means 135 so that unillustrated driving means (motor, solenoid and the like) are operated to cause the erase head 117 and the thermal head 115 to hang out against the travelling path 108.

Figure 17:
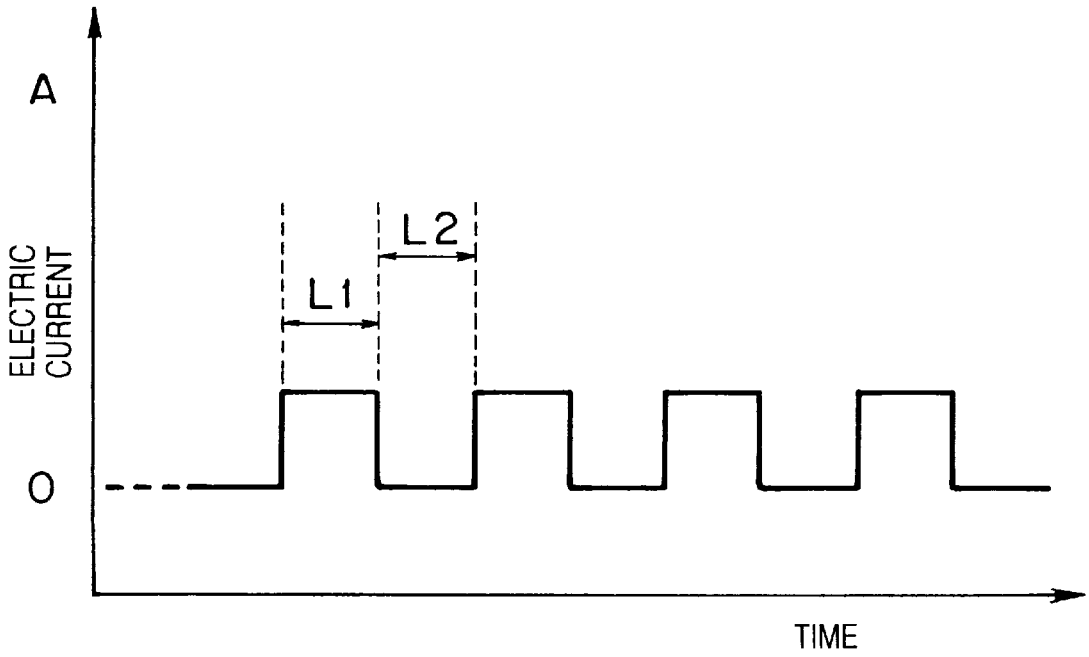
FIG. 17 is a graph showing a waveform of electric current applied to the erase head of the rewritable medium recording apparatus according to the second embodiment of the invention.

Subsequently, the control unit 131 outputs signals to erasing control means 136 and printing control means 139. On receiving the signal from the control unit 131, the erasing control means 136 starts to supply electric current to the erase head 117. This electric current is in the form of a rectangular wave as shown in FIG. 17. The erasing control means 136 controls the durations L1 and L2 of two fixed values of the rectangular wave so as to supply the electric current to the erase head 117 (actually to the thick-film heater 119). Current supply pattern is as shown in FIG. 17.

Figure 18:
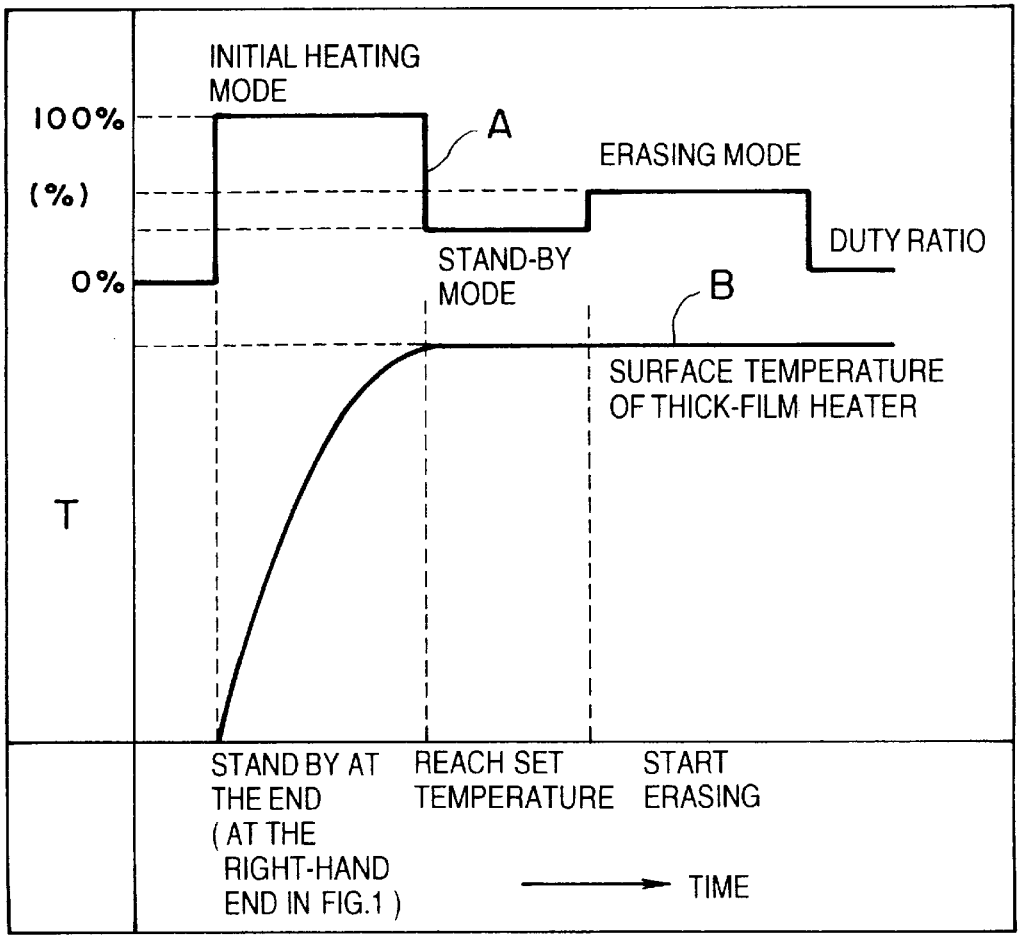
FIG. 18 is a graph showing a waveform of electric power applied to the erase head of the rewritable medium recording apparatus according to the second embodiment of the invention versus surface temperature of the erase head.

As shown in FIG. 18, in a state that the rewritable recording medium 21 stands by at the end of the travelling path 108, the control unit 131 outputs a control signal to the erasing control means 136 so as to set an initial heating mode. At this time, in the initial heating mode, the erasing control means 136 applies an electric current with duty ratio L1:L2=9:1~10:0 as shown in FIG. 18 to the erase head 117 to heat the same. In this embodiment, L2 is 0 (zero). One hundred percent duty ratio shown in FIG. 18 means that L1:L2=10:0, that is, L2 is 0 (zero). Then, second temperature detecting means 137 receives a signal correlated with the temperature output by the thermistor 121 shown in FIG. 14 to send a first temperature signal to the control unit 131 on the basis of the information from the thermistor 121. The control unit 131 heats the erase head 117 as high as a predetermined temperature at one hundred percent duty ratio while making reference to the first temperature signal. As soon as the control unit 131 recognizes from the first temperature signal that the erase head 117 reaches the erasing temperature (the temperature at which the printing area 21*a* of the rewritable recording medium can be erased), the control unit 131 outputs a control signal to the erasing control means 136 so as to set a stand-by mode. On receiving this signal, the erasing control means 136 supplies the electric current to the erase head 117 at a duty ratio of 15 to 23% (L1:L2=15~23:85~77). Such variation of the electric current keeps the erase head 117 at the erasing temperature. At this time, the erasing control means 136 changes the duty ratio of the electric current applied to the erase head 117 referring to the first temperature signal so as to keep the erasing temperature.

When the erase head 117 enters into the stand-by mode, the control unit 131 sends a control signal to the conveyance drive means 132 so as to rotatively drive the driving rollers 109, 110, 123 and the platen rollers 116, 122 to cause the rewritable recording medium 21 to move toward the sensor 125. Then, the rewritable recording medium 21 starts to come in contact with the erase head 117.

After the sensor 129 detects that the rewritable recording medium 21 starts to move, the sensor 128 immediately in front of the erase head 117 detects the rewritable recording medium 21, and outputs a detection signal to the control unit 131 via the position detecting means 130. The control unit 131 then outputs a control signal to the erasing control means 136 so as to set an erasing mode. On receiving this control signal, the erasing control means 136 supplies the electric current to the erase head 117 so that the duty ratio becomes higher than that in the stand-by mode (that is, the duration L1 is made longer to prevent the temperature drop of the erase head 117 caused by contact with the rewritable recording medium 21).

At this time, the duty ratio of the electric current is determined as follows. First of all, the erasing control means 136 reads out through the control unit 131 these data which relates to the duty ratio of the electric current in the erasing mode (referred to as correction data, hereinafter) and stored in memory means 138. The correction data have been previously prepared for correction of a decrease in erasing temperature attributed to materials of the rewritable recording medium 21 and the erase head 117, area of contact between the erase head 117 and the rewritable recording medium 21 and so on. Further, based on the temperature information measured by the thermistor provided on the thermal head 115 for measuring the ambient temperature, a first temperature detecting means 139*a* outputs a second temperature signal which in turn is input to the erasing control means 136.

The erasing control means 136 decides the duty ratio of the electric current in the erasing mode referring to the correction data from the memory means 138 and the second temperature signal. This is because the erasing temperature may possibly be somewhat changed depending upon the ambient temperature. Actually, however, since the correction data are prepared on the basis of room temperature, there is no possibility that the second temperature signal causes a large deviation from the duty ratio of the correction data. Incidentally, even in this case, the first temperature signal is referred to, and the temperature control is performed even when the temperature of the erase head 117 is suddenly changed. Such control can correct the erasing temperature drop and the like which can be caused by the ambient temperature and the contact between the rewritable recording medium 21 and the erase head 117, thereby preventing the temperature of the erase head 117 from deviating from the erasing temperature. It is therefore possible to obtain the stable erasing characteristic. Further, since the ambient temperature is measured by the thermistor equipped beforehand to the thermal head 115, the number of component parts can be reduced.

Incidentally, in the present embodiment, the duty ratio is decided on the basis of the correction data and the second temperature signal. However, it is also possible that, data prepared for correction of a decrease in erasing temperature, which may be caused by the materials of the rewritable recording medium 21 and the erase head 117, area of contact between the erase head 117 and the rewritable recording medium 21 and so on, may be previously stored in an amount corresponding to the ambient temperature so that the data on the present ambient temperature is read out from the memory means 138 in response to the second temperature signal.

Immediately after the print on the printing area 21*a* of the rewritable recording medium 21 is erased by the erase head 117 in the above-described manner, a predetermined visible image is formed on the printing area 21*a* by means of the thermal head 115. At this time, referring to the data stored in the memory means 138, the data transmitted from the external apparatus and so on, the printing control means 139 causes the dot heating elements of the thermal head 115 to generate heat to form the visible image on the printing area 21*a*.

After the predetermined visible image is formed on the printing area 21*a*, when the rewritable recording medium 21 passes over the magnetic head 113, the control unit 131 outputs a control signal to data read/write means 133 so as to write a predetermined data. In response to this signal, the data read/write means 133 writes the predetermined data on the recording area 21*b* by means of the magnetic head 113, and then the rewritable recording medium 21 is released out of the travelling path 108.

As has been described above, according to the present embodiment, it is possible to stably erase and form the visible image on the printing area 21*a* and provide the remarkable advantage of reducing the cost due to the decrease in the number of component parts and the like.

Further, even for use in the general market where the interval between recording and erasing of the visible image cannot be specified, it is unavoidable to erase at the fixed erasing temperature. Even if the erasing temperature range is a little shifted the existence of some erasable range of the recording medium itself in most cases enable erasing at the fixed erasing temperature only by means of the erase head 117 provided that the erasing temperature is in that range. However, if a shift of erasing temperature range causes the fixed erasing temperature to be out of that range, the visible image to be erased is left unerased, and therefore another visible image recorded succeedingly is superimposed on the unerased image, resulting in a problem that it becomes hard to recognize the visible image.

Figure 19:
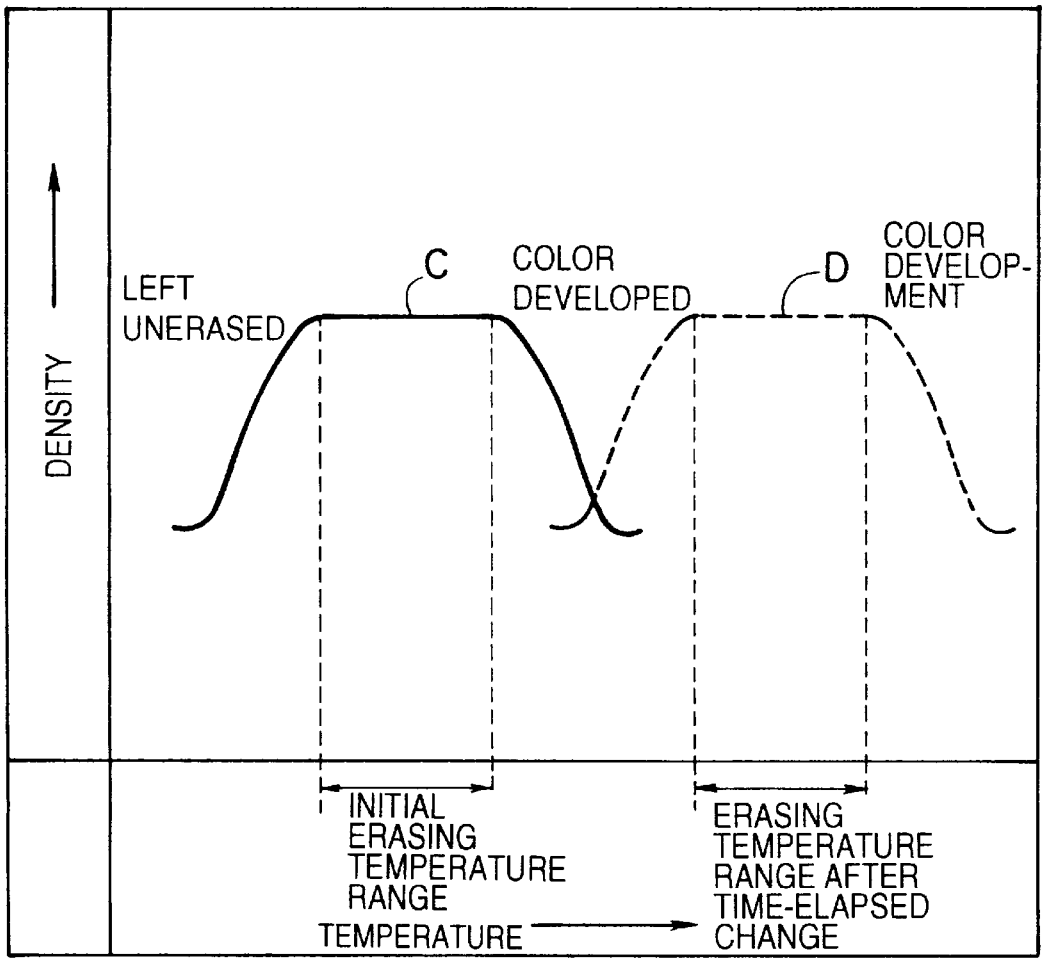
FIG. 19 is a graph showing the relationship between the density of visible image on the rewritable recording medium according to the second embodiment of the invention and temperature applied to the recording medium.

To cope with this, whether or not the visible image is left unerased after being erased by means of the erase head 117, when forming a new visible image by the thermal head 115, the portion on which the new visible image is to be formed is heated to the extent that the recording medium is allowed to develop color, while the other portion is heated up to the erasing temperature. Such control in this way makes the time interval between the previous heating and the next heating constant, so that the erasing temperature always falls within the range shown by solid line in FIG. 19, and therefore the fixed erasing and recording temperatures are serviceable at all times to make it possible to erase and record in a stable manner.

Further, in cases where the rewritable medium recording apparatus has a magnetic recording device such as the magnetic head 113 as in the present embodiment, provision of the recording area 21*b* on the rewritable recording medium 21 makes it feasilble to magnetically record the date and time of the recording of a visible image on the recording area 21*b* when the visible image is recorded. When erasing the visible image, the magnetic data is read in first of all. The data for the date and time of the last recording of the visible image thus obtained indicates how much the optimum erasing temperature for the visible image is shifted, and therefore it is possible to decide the optimum erasing temperature for the visible image on the recording medium inserted in the recording apparatus. Moreover, even in cases where the optimum recording and erasing temperatures for the visible image differ according to the type of rewritable recording medium 21, the type of rewritable recording medium 21 is magnetically recorded on the recording area 21*b* when recording a visible image. When erasing and recording the visible image at the next time, the magnetic data is read in first. The data on the type of rewritable recording medium thus obtained enables deciding the erasing and recording temperatures for the visible image.

According to the present invention, the rise time elapsing from the instant at which the power is turned on is reduced to eliminate consumption of wasteful power in the stand-by condition as compared with the conventional recording apparatus. In addition, it is possible to erase and record the visible image with certainty. Further, in the visible image recording apparatus comprising thermal energy supply means such as a thick-film heater capable of substantially erasing the visible image recorded on the recording medium in three heating modes including initial heating, stand-by and erasing modes, recording means such as a thermal head for erasing the visible image left unerased by the thermal energy supply means and for overwriting and recording of a new visible image at the same time, and magnetic recording device such as a magnetic head, provision of the magnetic recording layer on the recording medium, makes it feasible to magnetically record the date and time of the recording of the visible image on the magnetic recording layer formed on the recording medium when the visible image is recorded, so that when the visible image is erased at the next time, it is possible to decide the optimum erasing temperature for the visible image according to the data on the date and time of the earlier magnetic recording. Moreover, even in cases where the optimum recording and erasing temperatures for the visible image differ according to the type of recording medium, such provision of the magnetic recording layer on the recording medium makes it the type of recording medium possible to magnetically record on the magnetic recording layer when a visible image is recorded, so that it is possible to decide the erasing and recording temperatures for the visible image according to the data on the type of recording medium magnetically recorded on the magnetic recording layer when the visible image is erased and recorded at the next time.

(Embodiment 3)

An apparatus in which the first and second embodiments are combined can obtain a further useful effect. Namely, the apparatus of the first embodiment modified so as to perform the thermal control in the same manner as the second embodiment makes it feasible to reduce the size of the apparatus and perform the erasing and recording of the visible image with certainty. In other words, if the thermal control performed by the erase head 24 and the print head 23 in the first embodiment is performed by means of the thermal head 115 and the erase head 117 described in the second embodiment, it is possible to obtain a compact and low-power consumption apparatus capable of erasing and recording the visible image with certainty.

What is claimed is:

1. A rewritable medium recording apparatus comprising:

a travelling path along which a rewritable recording medium is moved;

recording means for performing at least one of reproduction and recording of data on a recording area of the rewritable recording medium;

image forming means for forming a predetermined visible image by heating the rewritable recording medium up to a first temperature;

erasing means for erasing the visible image formed on the rewritable recording medium by heating the rewritable recording medium up to a second temperature;

first temperature detecting means for measuring the ambient temperature to output an ambient temperature signal;

storage means for storing a temperature control pattern for said erasing means; and a control unit for controlling an amount of heat applied to the rewritable recording medium on said erasing means referring to said ambient temperature signal and the temperature control pattern stored in said storage means so as to keep the rewritable recording medium at the second temperature to erase the visible image on the rewritable recording medium by said erasing means.

2. A rewritable medium recording apparatus according to claim 1, further comprising second temperature detecting means for measuring the temperature of the erasing means to output an erasing temperature signal, and wherein the control unit causes the erasing means to erase the visible image on the rewritable recording medium, referring to the ambient temperature signal, erasing temperature signal and temperature control pattern stored in said storage means.

3. A rewritable medium recording apparatus according to claim 1, wherein the erasing means comprises a thick-film heater and the image forming means comprises a thermal head.

4. A rewritable medium recording apparatus according to claim 3, wherein electric current of rectangular waveform is supplied to the thick-film heater for control of heating.

5. A rewritable medium recording apparatus according to claim 4, wherein the thermal control mode for the thick-film heater includes an initial heating mode, a stand-by mode and an erasing mode, and the electric current of rectangular waveform supplied to said thick-film heater differs in duration of supply in the respective modes.

6. A rewritable medium recording apparatus according to claim 1, wherein the erasing means and the image forming means are connected to each other, and said erasing means and said image forming means are driven by a single driving means.

7. A rewritable medium recording apparatus according to claim 6, wherein the erasing means and the image forming means are rotatably mounted.

8. A rewritable medium recording apparatus according to claim 7, wherein a load applied to the rewritable recording medium is set such that a load on The image forming means side exceeds that on the erasing means side.

9. A rewritable medium recording apparatus according to claim 6, wherein discharge means is provided in the travelling path for card.

* * * * *

UNITED STATES PATENT AND TRADEMARK OFFICE

CERTIFICATE OF CORRECTION

PATENT NO. : 6,011,570
DATED : January 4, 2000
INVENTOR(S) : Muranaka et al.

It is certified that error appears in the above-identified patent and that said Letters Patent is hereby corrected as shown below:

Column 1,
Line 8, change "there have been widely spread" to -- a type of --;
Line 9, change "apparatuses of the type having" to -- has become widespread, in which --;
Line 22, after "of" insert -- a --;
Line 31, after "silver" insert -- , --; and
Line 32, change "base, but when it" to -- base. However, when the printing area --.

Column 2,
Line 24, after "all" insert -- of the --, and change "process is" to -- processes are --.

Column 3,
Line 7, after "by" insert -- an --.

Column 5,
Line 12, change "process" to -- processes --;
Line 13, change "is" to -- are --; and
Line 14, change "recipocation" to -- reciprocation --.

Column 6,
Line 15, change "By the way" to -- In addition --;
Line 49, change "cope with this" to -- avoid this problem --;
Line 51, change "a" to -- an adjustment --, and delete "by something"; and
Line 52, change "nearby" to -- by the user or the system after processing has finished --.

UNITED STATES PATENT AND TRADEMARK OFFICE

CERTIFICATE OF CORRECTION

PATENT NO. : 6,011,570
DATED : January 4, 2000
INVENTOR(S) : Muranaka et al.

It is certified that error appears in the above-identified patent and that said Letters Patent is hereby corrected as shown below:

Column 7,
Line 4, after "8,", insert -- the --;
Line 6, change "This" to -- The --;
Line 8, change "unless" to -- accidentally because --, change "is" to -- must be --, and change ", and" to -- . Moreover --;
line 9, delete "that", and delete "only";
Line 10, change "having an aim of releasing the locked condition" to -- intending to do so --;
Line 11, change "can be" to -- is --;
Line 12, change "nearby like" to -- flat, such as --;
Line 21, change "erased, the" to -- erased. The --, after "are" delete "so", and after "connected" insert -- so --;
Line 26, change"card, and therefore" to -- card. Therefore, --;
Line 51, after "21" change ", and however" to --. However, --.

Column 8,
Line 31, change "14" to -- 14A, 14B --.

Column 9,
Line 12, change "Incidentally, the" to -- The --;
Line 23, change "Operation and the like" to -- The operation --;
Line 24, before "be" insert -- now --;
Line 40, change "Reproduced" to -- The reproduced --;

Column 10,
Line 3, change "Current" to -- The current --.

Column 11,
Line 67, change "enable" to -- enables --.

UNITED STATES PATENT AND TRADEMARK OFFICE

CERTIFICATE OF CORRECTION

PATENT NO. : 6,011,570
DATED : January 4, 2000
INVENTOR(S) : Muranaka et al.

It is certified that error appears in the above-identified patent and that said Letters Patent is hereby corrected as shown below:

Column 12,
Line 2, insert -- , -- after "117"
Line 9, change "cope with this" to -- solve the above-mentioned problem --;
Line 24, insert -- (-- before "as", and change "embodiment," to -- embodiment), --; and
Line 26, change "feasilble" to -- feasible --.

Column 13,
Line 40, change "the" to -- an --.

Column 14,
Line 3, before "referring" insert -- by --;
Line 13, change "medium," to -- medium by --;
Line 14, before "erasing" insert -- said --;
Line 15, before "temperature" insert -- the --;
Line 21, after "wherein" insert -- an --;
Line 31, after "and" insert -- said apparatus further comprises a single driving means for driving --;
Line 39, "change "The" to -- an --;
Line 40, change "the" to -- an --;
Line 42, change "wherein" to -- further comprising --, and delete "is"; and
Line 43, change "for" to -- the --.

Signed and Sealed this

Twenty-sixth Day of February, 2002

*Attest:*

*Attesting Officer*

JAMES E. ROGAN
*Director of the United States Patent and Trademark Office*